US006340092B1

(12) United States Patent
McGrath, Jr.

(10) Patent No.: US 6,340,092 B1
(45) Date of Patent: Jan. 22, 2002

(54) SPACE SAVER

(76) Inventor: Donald L. McGrath, Jr., P.O. Box 433, Orland Park, IL (US) 60462

( * ) Notice: Subject to any disclaimer, the term of this patent is extended or adjusted under 35 U.S.C. 154(b) by 0 days.

(21) Appl. No.: 09/750,823

(22) Filed: Dec. 28, 2000

(51) Int. Cl.[7] ..... H47F 5/00
(52) U.S. Cl. ..... 211/169; 211/96; 211/47
(58) Field of Search ..... 211/47, 48, 96, 211/168, 169

(56) References Cited

U.S. PATENT DOCUMENTS

| | | | | | |
|---|---|---|---|---|---|
| 728,219 | A | | 5/1903 | Feldmann, Jr. et al. | |
| 1,044,381 | A | * | 11/1912 | Harr | |
| 1,125,994 | A | | 1/1915 | Feldman, Jr. et al. | |
| 1,716,807 | A | | 6/1929 | Wallerstein | |
| 1,784,577 | A | | 12/1930 | Coleman | |
| 3,000,113 | A | | 9/1961 | Olson | |
| 3,514,883 | A | * | 6/1970 | Albright | |
| 3,517,827 | A | * | 6/1970 | Crosslen et al. | 211/163 |
| 3,570,676 | A | * | 3/1971 | Crosslen | 211/169 X |
| 3,603,461 | A | | 9/1971 | Best | |
| 3,661,273 | A | * | 5/1972 | Crosslen | 211/169 |
| 3,722,699 | A | * | 3/1973 | Crosslen | 211/169 |
| 3,760,952 | A | | 9/1973 | White | |
| 3,777,896 | A | | 12/1973 | Ehrlich | |
| 4,678,086 | A | * | 7/1987 | Nervig | 211/47 |
| D337,676 | S | * | 7/1993 | Hardy | |
| 5,226,548 | A | | 7/1993 | Koeppel | |
| 5,405,193 | A | * | 4/1995 | Herrenbruck | |
| 5,452,809 | A | | 9/1995 | Capel | |
| 5,551,577 | A | | 9/1996 | Hagopian | |
| 5,588,537 | A | * | 12/1996 | Hagopian | 211/4 |
| 5,782,366 | A | * | 7/1998 | Garza | 211/169 X |
| 6,260,296 | B1 | * | 7/2001 | Carney | 211/169 X |
| 6,286,692 | B1 | * | 9/2001 | Hemping | 211/169 |

* cited by examiner

*Primary Examiner*—Robert W. Gibson, Jr.
(74) *Attorney, Agent, or Firm*—Robert F. Kemp, Esq.; John G. Premo, Esq.

(57) ABSTRACT

A display rack for ceramic tiles having two framed sides, a back, and an open front. It has the following additional elements: left and right frames having tops, bottoms, backs, and fronts. Further, it has a top beam, having a front, a back, a top, and a bottom, connecting the back of the tops of the left and right frames. Also, there is a bottom beam, having a front, a back, a top, and a base, connecting the back of the bottoms of the left and right frames at a point slightly ahead of the position of the top beam. Also, there is a plurality of equidistantly, spaced apart angled pins located in the bottom of the top beam and in the top of the bottom beam, arranged in the form of approximately equal arcs that has their apex at the center of the top and bottom beams. A further element of the display rack is a plurality of wings removably mounted within the display rack. These wings have vertical holes in the tops and bottoms of their backs that mate with the pins. The wings contain a plurality of opposed parallel channels, having a back and a front, mounted horizontally on opposite sides of the sides of the wings for receiving in a sliding relationship vertical ceramic tile sample boards. A final element is the presence of resilient bumpers attached to the wings.

17 Claims, 4 Drawing Sheets

SPACE SAVER

FIELD OF THE INVENTION

The invention relates to display racks for floor and wall coverings.

BACKGROUND OF THE INVENTION

The invention relates to display racks for floor and wall coverings.

DESCRIPTION OF THE PRIOR ART

Ceramic tiles are usually displayed upon sample boards that can be moved about display rooms to allow customers to see the tiles in various lights or against certain colors or fabrics. In recent years, there has been a trend to increase the size of individual tiles, particularly those used as floor coverings. To create more attractive displays, several tiles are often attached to each sample board, either by layering or water saw cutting pieces to fit, and, therefore, create, a more artistic presentation. These new innovative display techniques have created a need for display racks that are capable of displaying tiles in a limited space. Ceramic tiles weigh approximately 3.5 pounds per square foot. Hence, display racks for these tiles must be sturdy.

A known means for displaying tiles mounted on display boards is to incorporate them into display racks that contain multiple hinged wings. These display racks have the advantage of allowing a large number of tiles to be available for inspection by customers, yet, at the same time, occupying a relatively small amount of valuable floor space in a retail establishment. These display racks promote tile breakage, since the wings that are fitted with back pivot pins knock into one another, and the displayed tiles often contact one another with force sufficient to cause breakage.

A proposed method for preventing this accidental breakage is to mount resilient stops or bumpers on the wings. These stops are usually mounted on the front edge of the wings. While preventing breakage to a limited extent, these stops are not entirely satisfactory, particularly when layered tiles are mounted on the display racks.

Another problem with prior art display racks is that the wings are permanently mounted on the racks. Frequently, there is no provision for easily removing individual tiles from the racks. Often, the racks are not movable and are located in dark, poorly illuminated areas, thus making a poor presentation of the tiles on display. In nearly all instances, there is no provision for the easy removal or replacement of the wings. In addition, many prior art racks are unitary in construction and cannot be disassembled for shipping or storage.

The invention, therefore, provides to the art a number of improvements and advantages over the prior art. It provides a sturdy space saving rack for displaying ceramic tiles and other floor and wall coverings, such as glass or marble tiles that are included in the meaning of the term "ceramic tiles" as it is used in the specification and claims. It stores upon rotatable vertical wings a large number of easily removable tile containing sample boards that may be of different sizes. The display rack also allows the wings to remain in the open or closed position without moving. It also uses a bumper system that protects the displayed tiles from damage or breakage due to accidental moving of the wings. It provides interchangeable wings designed to be removed from the display rack and stored elsewhere in a manner allowing the mounted tiles to be viewed. With the quick removal feature, it is possible to quickly display new tile selections when old ones are removed.

SUMMARY OF THE INVENTION

The display rack of the invention for ceramic tiles has two framed sides, a back, and an open front. It has the following specific elements: left and right frames, having tops, bottoms, backs, and fronts. Further, it has a top beam, having a front, a top, and a bottom, connecting the back of the tops of the left and right frames. Also, there is a bottom beam, having a front, a top, and a base, connecting the back of the bottoms of the left and right frames at a point forward of the position of the top beam.

A plurality of spaced apart, angled pins is located in the bottom of the top beam and in the top of the bottom beam. The spacing is desirably equidistant. They are arranged in the form of approximately equal arcs that have their apex at the center of the top and bottom beams. The pins in the top beam are longer than the pins in the bottom beam. There is a top covering at least the front portions of the left and right frames, and a horizontal foot securing the front ends of the bottoms of the left and right frames.

A further element of the display rack is a plurality of wings removably mounted within the display rack. These wings are rectangular frames, having sides, tops, bottoms, backs, and fronts, and are sized to be received within the display rack. These wings have vertical holes in the top and bottom of their backs that mate with and are longer than the pins. The wings contain a plurality of parallel channels, having U-shaped sides or guides, a back, and a front, and are usually opposed. They are mounted horizontally, on opposite sides of the sides of the wings, for receiving in a sliding relationship vertical ceramic tile sample boards. A final element is the presence of resilient bumpers attached to the wings.

The display rack described above may contain the additional features. The base of the bottom beam at about its center contains an adjustable leg to prevent sagging of the center portion of the back beam. To improve appearance and visibility of the tiles displayed in the rack, the back and top are covered. The front of the top beam contains a light and a reflector in the form of an assembly that may be hinged for ease of servicing the lights. This allows easing viewing of the displayed tiles by customers. For the sake of convenience, the lights are controlled by a switch located on the front of one side of the display rack. The reflector, in addition to directing light on the wings, may have a front portion containing an opaque light transmitting area for advertising purposes.

The pins are at an angle of about 1.5° to 10°, preferably 2° to 5°, and, most preferably, 3° to 4°. The vertical holes in the back of the wings should contain approximately matching angles and be oversized. The angled pins, coupled with their arcuate placement, allow the wings to act as though they were pages of a flat or tilted loosely bound book. As the wings are turned, they remain in place, whether it be the first wing turned, or all of the wings, thereby exposing the last one. To allow the wings to be turned easily, the angled pins on the top of the bottom beam are fitted with washers that mate with grommets located in the holes in the bottom of the vertical back side of the wing. The bottom front of the wings are fitted with legs.

The backs of the parallel channels contain a vertical stop. The wings contain U-shaped parallel channels. They are opposed when the sides of the sample boards are identical. They have a top channel and a bottom channel, each having inner and outer sides, a back, and a front, mounted horizontally on opposite sides of the sides of the wings for receiving in a vertical sliding relationship ceramic tile sample boards. They have the inner sides of the top and bottom channels attached to the sides of the frame. The outer sides of the top channel are taller than the inner sides on the bottom channel. This allows all of the sample boards to be removed by sliding them out from the front of the channels, which is open. They may be removed by being lifted vertically upward and then outwardly. The vertical space between the channels may be varied to accommodate sample boards of different sizes. The resilient bumpers are mounted on the front, preferably, on the top front end of the wings, and are curved. Further, the resilient bumpers are detachable. Another useful feature of the invention is that the display rack is capable of being assembled and disassembled, since its elements are designed to be fastened using fasteners, such as screws and nuts and bolts.

BRIEF DESCRIPTION OF THE DRAWINGS

Unless otherwise specified, in the drawings like parts have like numbers.

DETAILED DESCRIPTION OF THE INVENTION

Figure 1:
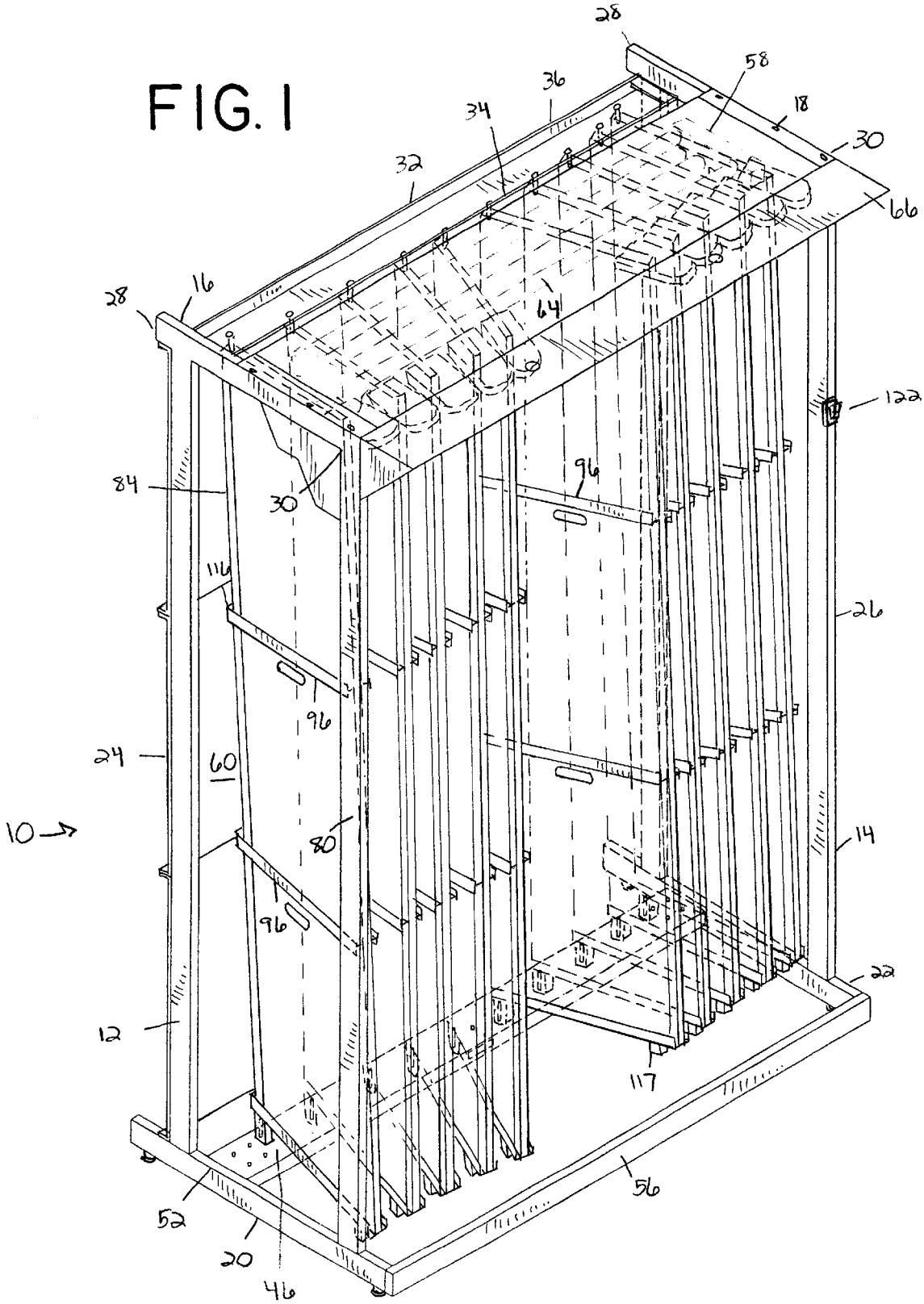
FIG. 1 is an elevational perspective view of the ceramic tile display rack of the invention.

With specific reference to the drawings, FIG. 1 shows the display rack of the invention, designated generally by the number 10. It has a left frame 12, and a right frame 14. The top of the frames 12 and 14 are designed by the numbers 16 and 18, respectively, and the bottom of the frames by the numbers 20 and 22. The frames also have sides 24 and 26. The frames also have a back 28 and a front 30.

To connect the frames, there is utilized a top beam 32, having a front 34, a back 36, and a bottom 38. This is shown to best advantage in FIGS. 1, 2, and 3. The top beam 32 has ends 40, which attach to the top backs 28 of frames 12 and 14.

Figure 2:
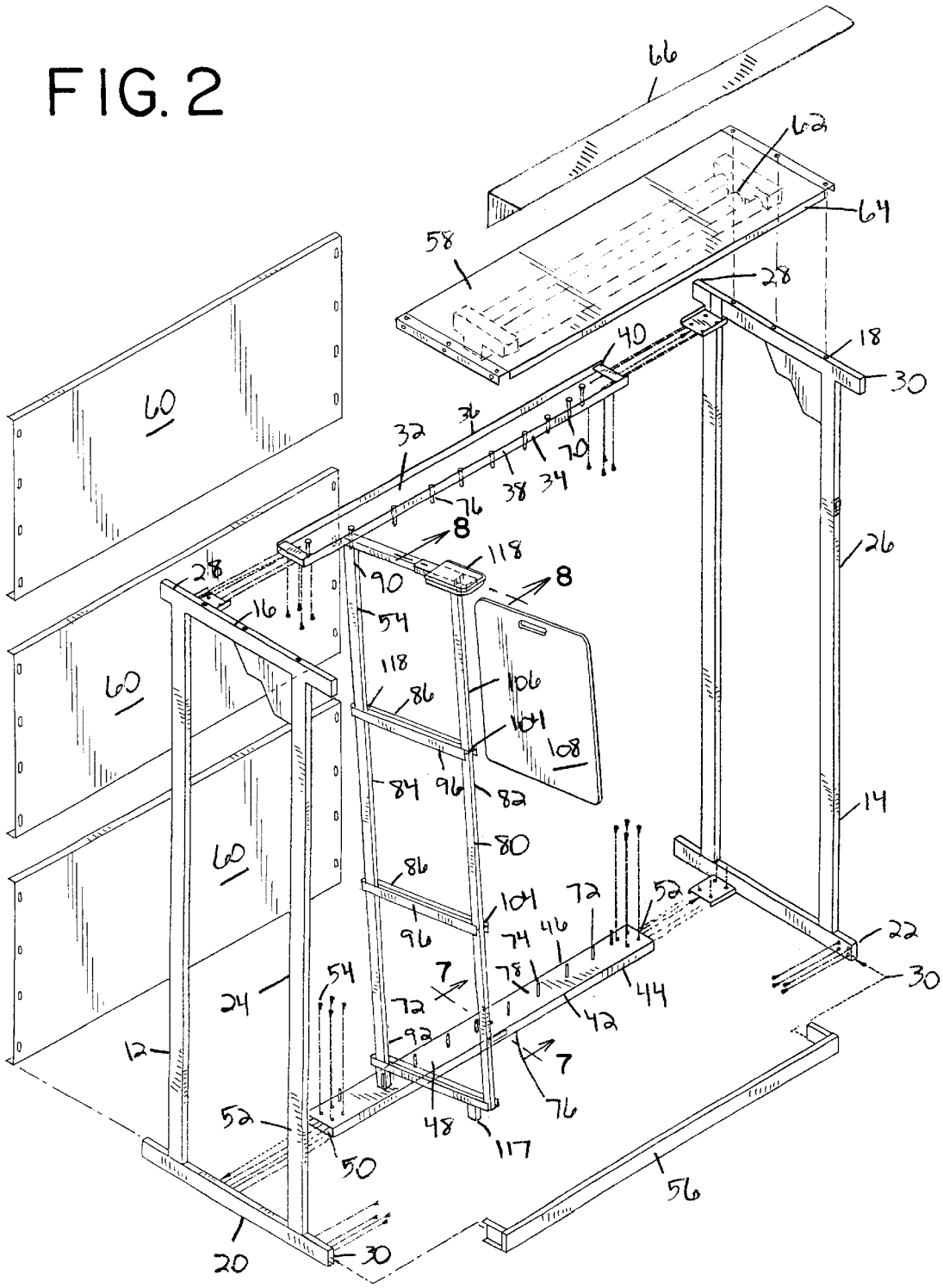
FIG. 2 is an elevational exploded view of the various elements used to make up the ceramic tile display rack of the invention.
Figure 3:
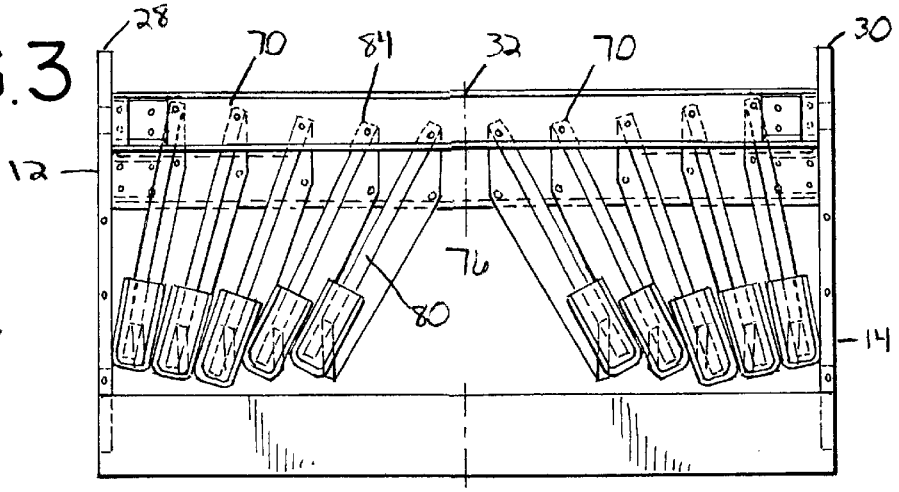
FIG. 3 is a top view corresponding to FIG. 1.
Figure 7:
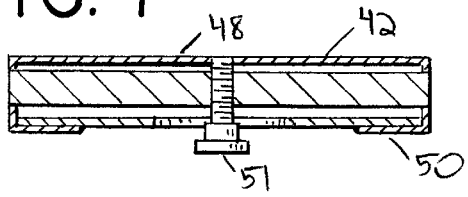
FIG. 7 is a horizontal front view taken across the lines 7—7 of FIG. 2.
Figure 8:
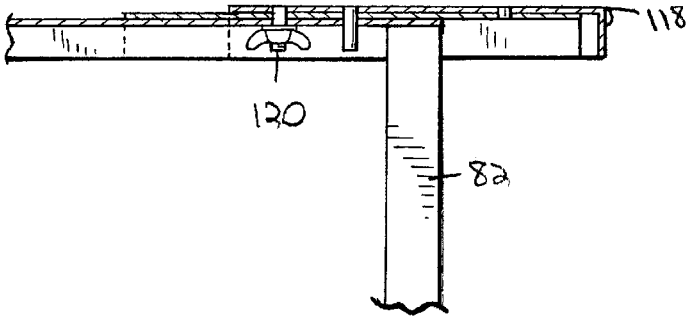
FIG. 8 is a partial, detailed horizontal view taken across the lines 8—8 of FIG. 2.

The backs 28 and 30 of bottoms of the frames 20 and 22 are connected by bottom beam 42, having a front 44, a back 46, a top 48, and a bottom 50. The bottom 50 of bottom beam 42 contains a threaded leg 51, which allows for center support of the beam, thereby preventing sagging due to the weight of the ceramic tiles which it supports. (See specifically FIG. 7.) The ends 50 and 52 of bottom beam 42 are fastened to the back top 28 in a forward offset position in relation to top beam 32. This is shown in FIGS. 1 and 2. Both the top beam 32 and the bottom beam 42 are mounted to frames 12 and 14 by means of screws or nuts and bolts 54. (See FIG. 2.)

Figure 4:
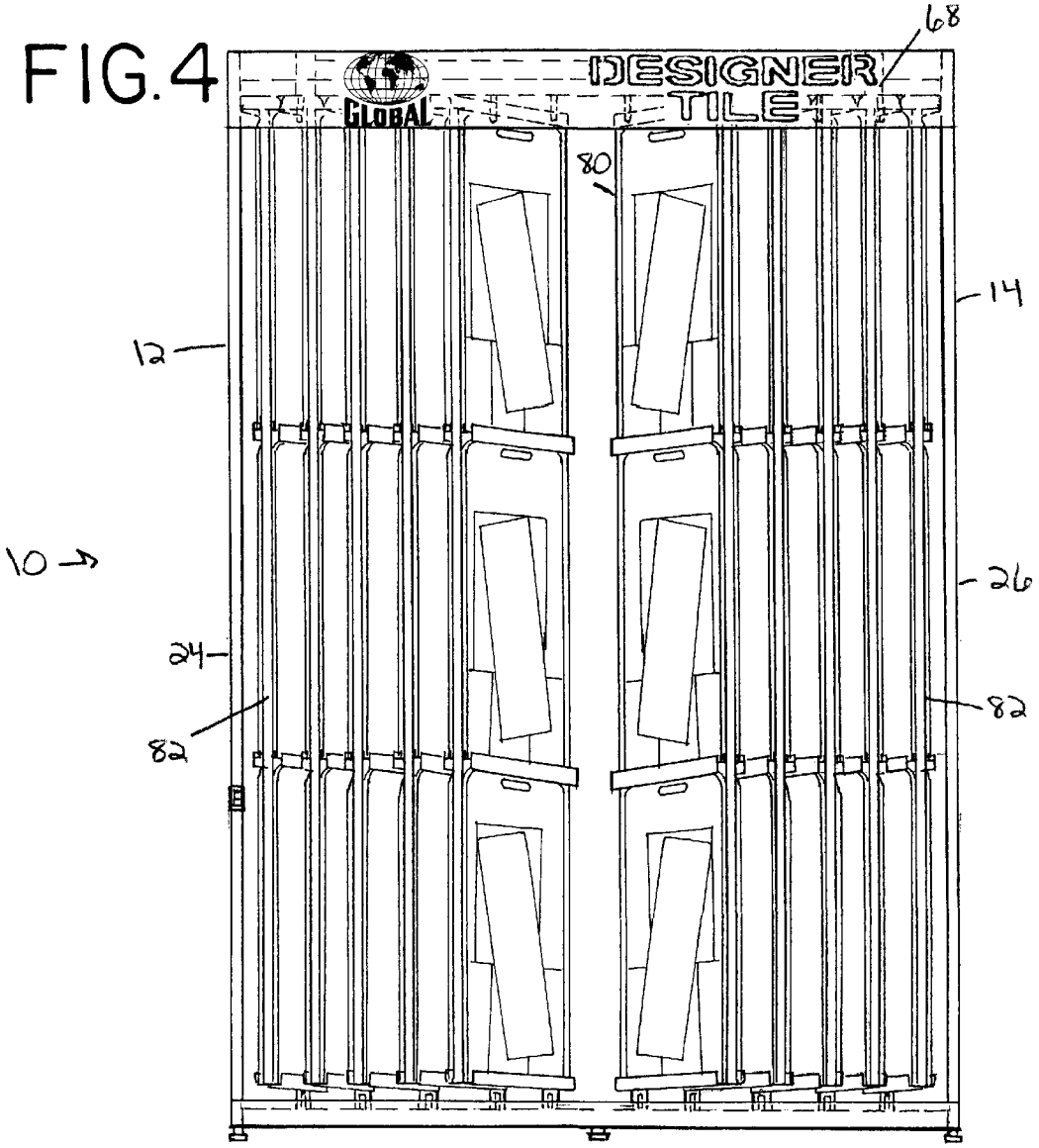
FIG. 4 is a front elevational view of FIG. 3.
Figure 5:
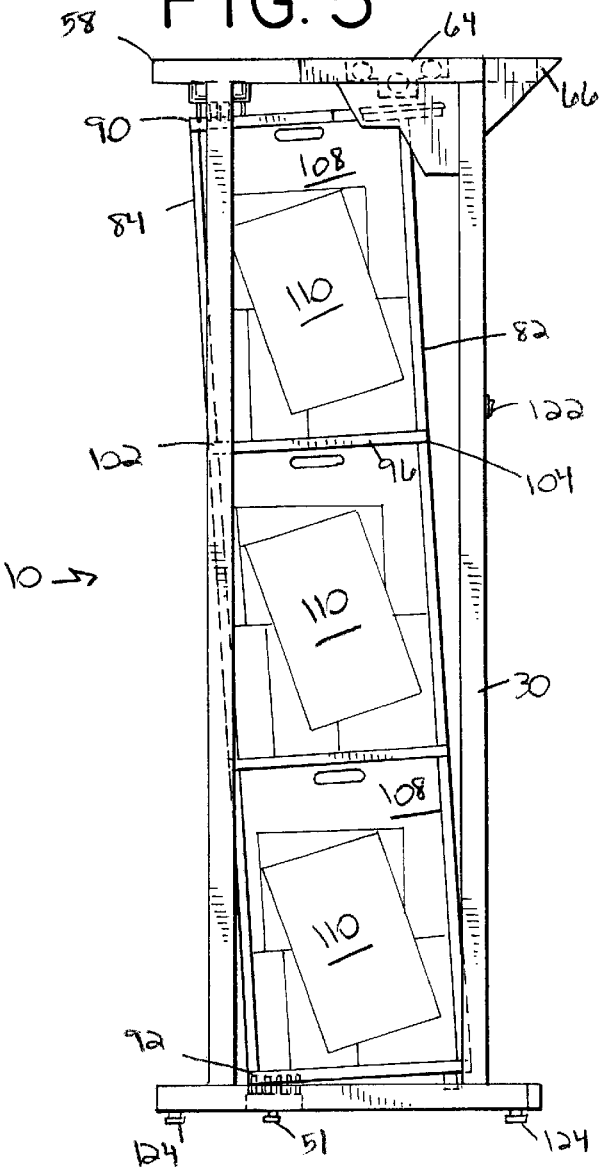
FIG. 5 is a side view of FIG. 4.

To provide additional stability to the display rack 10, the bottoms 20 and 22 of the frames 12 and 14 are fastened by means of horizontal foot 56. To secure the top area defined by the numbers 16 and 18 of frames 12 and 14, they are fitted with a top cover 58, which may partially or fully cover the top area of the frames 12 and 14. Optionally, the back 28 of the frames 12 and 14 are covered with panels 60 to provide a solid back. The back 28, which should be finished in a light reflecting color, allows for the reflection of light on to the displayed articles within the display rack 10, which is furnished by a fluorescent light 62, having its front end 64, covered by an angular reflector 66, which may be hinged for servicing, as shown in FIG. 4, and which contains an opaque advertising display 68.

An important feature of the invention resides in fitting the bottom 38 of top beam 32 with a plurality of pins 70. In a similar fashion, the top 48 of bottom beam 42 is fitted with a corresponding number of pins 72. Pins 70 and 72 are arranged on their respective beams, 32 and 42, in a mirror image arrangement. Shown specifically in FIGS. 2 and 3, the pins 70 and 72 are arranged in the form of an arc 74, which has its apex 76 located at the center of beams 32 and 42.

As mentioned above, the bottom beam 42 is offset in a direction in advance of the top beam 32. Since this arrangement aligns the pins 70 and 72 so that their ends form a projected straight line, it is necessary that they be angled. As previously set forth, the preferred angle of the pins 70 and 72 is 3–4°. In a preferred embodiment of the invention, the pins 72, located in bottom beam 42, are fitted with a plastic washer 78.

The display rack 10 of the invention is designed to hold in a nearly vertical position a plurality of wings 80. The wings 80 are constructed in the form of rectangular frames having a vertical front side 82 and a vertical back side 84. The top 86 and the bottom 88 of the vertical back side 84 are fitted with holes 90 and 92, which are deeper and are of greater depth than pins 70 and 72. They are also of greater diameter than the pins 70 and 72. They are angled to correspond to the angle of the pins 70 and 72. Further, holes 92 in the bottoms 88 of the vertical back side 84 contain a plastic grommet 94, which is constructed of the same material as washer 78, fitted over pins 72.

Figure 6:
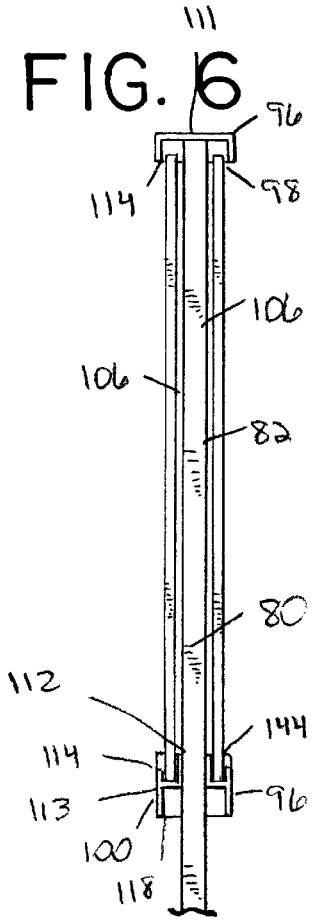
FIG. 6 is a vertical view of a section of a wing holding two tile sample boards.

The wings 80 contain U-shaped opposed vertical parallel channels 96, mounted horizontally on opposite sides of the sides 106 of the wings 80 for receiving in a sliding relationship vertical ceramic tile sample boards 108, upon which ceramic tiles 110 are mounted. The opposed vertical parallel channels 96 include a top channel 98 and a bottom channel 100. (See FIG. 6.) They each have a back 102 and a front 104. The U-shaped channels 96 have top and bottom inner sides 111 and 112, respectively, attached to the sides 106 of the wings 80. The outer sides 113 of the bottom channel 100 are taller than the outer sides 114 located on the top channel 98. To prevent the ceramic tile sample boards 108 from advancing too far into the channels 96, the backs 102 of top and bottom channels 98 and 100 are fitted with stops 116.

A front bottom leg 117 is fitted to the bottom 88 of wing 80. The top 86 of the wings 80 is fitted with a horizontally positioned resilient curved bumper 118. It is mounted using a bolt and threaded wing nut assembly 120. For convenience in use by owners of ceramic tile display rooms, a switch 122 operates the fluorescent light 62. To allow the display rack 10 of the invention to be level on uneven floors, there are provided adjustable feet 124 in the bottom of the display rack 10.

As indicated earlier, ceramic tiles weigh approximately 3.5 pounds per square foot. By displaying large numbers of these tiles in display racks 10, a substantial weight is placed upon its members. To withstand the large amount of weight that the rack supports, it is necessary that the rack be constructed of strong, yet lightweight, materials. Rectangular heavy gauge steel tubing is ideally suited for this purpose. In the case of the bottom beam 42, it should be constructed of a heavier gauge metal or should otherwise be reinforced, since it bears the majority of the load.

As shown in the drawings, the sample boards 108, upon which is mounted the ceramic tile samples 110, are rectangular in shape. A typical dimension of such a board is 17⁷⁄₁₈ inches by 28 inches. While this dimension is typical for mounting most tiles for display in the display rack 10 of the invention, it is sometimes found useful to use a smaller size board, such as a board having a dimension of 17⁷⁄₁₈ inches by 19 inches. One of the advantages of the invention is that the channels 96 in the wings 80 may be constructed to have varying heights to accommodate both sizes. An advantage not believed to be available in the art is that by the configuration of the channels 96, the ceramic tile sample boards 108 may be removed by sliding them in a forward direction or by lifting them vertically and then outwardly from the channels 96 in which they are mounted.

The combination of grommets 94 in the bottom of the back end 84 of the wings 80 and the washers 78 on pin 72 in the top 48 of bottom beam 42 allow for a lubricated rotational movement of the wings 80. The most important feature provided for by the invention is that, due to the angled and arcuate configuration of the pins 70 and 72, each wing 80 can be displayed without either closing into adjacent wings or the sides 24 and 26 of the display rack 10. This is true of every wing 80, regardless of its position with respect to the other wings. The "open-book" analogy previously mentioned is believed to be appropriate and is illustrated in FIG. 4. Another important advantage of the invention is that, by placing the resilient bumpers 118 on the tops of the wings 80, it is possible to completely prevent unwanted contact of the wings 80, which might lead to chipping or breaking of the displayed ceramic tiles 110. The wings 80 are easily removable due to the combination of a short bottom pin 72 and a long top pin 70. Using this pin configuration, in conjunction with the corresponding holes 90 and 92, the wings 80 are readily removed from the display rack 10. This allows for display of the wings 80 in other places within a display room, such as by mounting against walls, or so that they can be readily stored or shipped. Finally, since the display rack 10 of the invention is assembled with threaded fasteners, it may be assembled or taken apart for purposes of shipping and storage.

I claim:

1. A display rack for ceramic tiles having two framed sides, a back and an open front comprising:

left and right frames having tops, bottoms, backs and fronts;

a top beam having a front, a back, a top, and a bottom connecting the back of the tops of the left and right frames;

a bottom beam having a front, a back, a top, and a base connecting the back of the bottoms of the left and right frames at a point forward of the position of the top beam;

a plurality of spaced apart angled pins located in the bottom of the top beam and in the top of the bottom beam, arranged in the form of equal arcs which have their apexes at the center of the fronts of the top and bottom beams, and the pins in the top beam are longer than the pins in the bottom beam;

a top covering at least the front portions of the left and right frames and a horizontal foot securing the front ends of the bottoms of the left and right frames;

a plurality of wings removably mounted within the display rack, with the wings being rectangular frames, having sides, tops, bottoms, backs, and fronts being sized to be received within the display rack;

vertical holes in the top and bottom of the backs of the wings that mate with and are longer than the pins;

a plurality of U-shaped parallel channels having inner and outer sides, a back, and a front, mounted horizontally on opposite sides of the sides of the wings for receiving in a sliding relationship vertical ceramic tile sample boards; and resilient bumpers attached to the wings.

2. The display rack of claim 1, where the base of the bottom beam at about its center contains an adjustable leg.

3. The display rack of claim 1, where its back is covered.

4. The display rack of claim 1, where its top is covered.

5. The display rack of claim 1, where the front of the top beam contains a light and reflector.

6. The display rack of claim 1, where the pins are at an angle of from about 1.5° to 10°.

7. The display rack of claim 6, where the angle is about from 2° to 5°.

8. The display rack of claim 6, where the angle is about from 3° to 4°.

9. The display rack of claim 1, where the angled pins on the top of the bottom beam are fitted with washers and the vertical holes in the bottom of the back of the wings contain grommets.

10. The display rack of claim 1, where the wings contain U-shaped vertically opposed parallel channels, having a top channel, and a bottom channel, each having inner and outer sides, a back, and a front, mounted horizontally on opposite sides of the sides of the wings for receiving in a sliding relationship vertical ceramic tile sample boards, and having the inner sides of the top and bottom channels attached to the sides of the frame, and the outer sides of the top channel being taller than the outer sides on the bottom channel.

11. The display rack of claim 1, where the resilient bumpers are mounted on the front end of the wings, and are curved.

12. The display rack of claim 11, where the resilient bumpers are detachable.

13. The display rack of claim 1, where the bottom front of the wings have legs.

14. A display rack for ceramic tiles having two framed sides, a covered back, and an open front comprising:

left and right frames having tops, bottoms, backs, and fronts;

a top beam, having a front, a back, a top, and a bottom, connecting the back of the tops of the left and right frames, and with the top containing a light and a reflector;

a bottom beam, having a front, a back, a top, and a base, connecting the back of the bottoms of the left and right frames at a point slightly ahead of the position of the top beam, and having near its center an adjustable leg;

a plurality of equidistant, spaced apart angled pins having an angle of about 1.5° to 10°, located in the bottom of the top beam and in the top of the bottom beam, arranged in the form of equal arcs, which have their apex at the center of the top and bottom beams, and the pins in the top beam are longer than the pins in the bottom beam;

a top cover for the frames and a horizontal foot, securing the front ends of the bottoms of the left and right frames;

a plurality of wings removably mounted within the display rack, which wings are rectangular frames, having sides, tops, bottoms, backs, and fronts, being sized to be received within the display rack, and having vertical holes in the top and the bottom of the backs of the wings that mate with and are longer than the pins;

a plurality of U-shaped, vertically opposed parallel channels, having a top channel and a bottom channel, each having inner and outer sides, a back, and a front, mounted horizontally on opposite sides of the sides of the wings for receiving in a sliding relationship vertical ceramic tile sample boards, and having the inner sides of the top and bottom channels attached to the sides of the frame, and the outer sides of the top channel being taller than the outer sides on the bottom channel.

15. The display rack of claim 14, where the angle is about from 2° to 5°.

16. The display rack of claim 15, where the angle is about from 3° to 4°.

17. The display rack of claim 14, where the angled pins on the top of the bottom beam are fitted with washers, and the vertical holes in the bottom of the back of the wings contain grommets.

* * * * *